US010352513B2

(12) United States Patent
Sonneman

(10) Patent No.: US 10,352,513 B2
(45) Date of Patent: Jul. 16, 2019

(54) LIGHTING SYSTEM WITH LINEAR POWER BEAMS

(71) Applicant: Contemporary Visions, LLC, Larchmont, NY (US)

(72) Inventor: Robert A. Sonneman, Mamaroneck, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 15/953,652

(22) Filed: Apr. 16, 2018

(65) Prior Publication Data

US 2018/0313503 A1 Nov. 1, 2018

Related U.S. Application Data

(60) Provisional application No. 62/490,862, filed on Apr. 27, 2017.

(51) Int. Cl.

| | |
|---|---|
| ***F21S 8/06*** | (2006.01) |
| ***F21V 23/00*** | (2015.01) |
| ***F21V 5/04*** | (2006.01) |
| ***F21V 23/06*** | (2006.01) |
| ***H01R 13/70*** | (2006.01) |
| *F21V 29/10* | (2015.01) |
| *H01R 25/14* | (2006.01) |
| *F21Y 115/10* | (2016.01) |

(52) U.S. Cl.

CPC ..... *F21S 8/063* (2013.01); *F21V 5/04* (2013.01); *F21V 23/001* (2013.01); *F21V 23/06* (2013.01); *H01R 13/70* (2013.01); *F21V 29/10* (2015.01); *F21Y 2115/10* (2016.08); *H01R 25/142* (2013.01); *H01R 25/145* (2013.01)

(58) Field of Classification Search

CPC ..... F21V 21/008; F21V 21/005

See application file for complete search history.

(56) References Cited

U.S. PATENT DOCUMENTS

| | | | | |
|---|---|---|---|---|
| 2003/0223232 | A1* | 12/2003 | Belfer | F21V 19/0085 362/219 |
| 2011/0317421 | A1* | 12/2011 | So | F21S 2/00 362/249.02 |
| 2014/0043802 | A1* | 2/2014 | Dings | F21S 2/005 362/221 |
| 2014/0268718 | A1* | 9/2014 | Yu | F21V 19/008 362/217.14 |
| 2016/0033098 | A1* | 2/2016 | Bergman | H02G 3/20 362/418 |

* cited by examiner

*Primary Examiner* — Evan P Dzierzynski

(74) *Attorney, Agent, or Firm* — Gottlieb, Rackman & Reisman, P.C.

(57) ABSTRACT

A modular canopy lighting system is described comprising suspension elements for suspending said system from a ceiling, power beams including internal power beams, and connectors for connecting beams with other beams and beams with suspenders and lighting elements. The system is modular with the beams assembled to preferably define a single plane. A variety of lighting elements are usable in the present system, including lighting elements embedded in beams. The lighting elements may be configured with lenses in order to, for example, direct or diffuse the emitted light.

16 Claims, 22 Drawing Sheets

LIGHTING SYSTEM WITH LINEAR POWER BEAMS

The present application claims priority to U.S. Provisional Patent Application No. 62/490,862, filed Apr. 27, 2017, and the contents of which are incorporated herein by reference.

BACKGROUND OF THE PRESENT INVENTION

Modern interior architectural design utilizes large open spaces with high ceilings. These open spaces can be reconfigured quickly and easily using modular and moveable walls. In this manner, enclosures and semi-open areas can be re-created, even on demand, meeting both aesthetics and functional requirements.

This approach to interior design creates a challenge to lighting professionals. Special lighting systems have to be provided that can be configured and reconfigured in the field quickly and easily as required, and yet provide aesthetically pleasing but proper lighting for both working and living spaces and their surroundings.

The present system has been created to fulfill these needs.

BRIEF DESCRIPTION OF THE PRESENT INVENTION

The power beam linear lighting system described herein is a uniquely integrated architectural lighting system combining linear downward and/or upward facing illumination with a two-circuit power track as well as the ability to reverse the facing in sections. In this application, the terms track and beam are being used interchangeably. The power track or beam can accept multiple light sources or luminaire components of varying types, which can attach to the power beam in any of several ways. The linear lighting beams can be suspended from a structural ceiling and used singularly or joined in an expansive array, thereby forming a variety of layout configurations and lighting options across an interior space. The lighting elements within the luminaries of the present invention can be of various forms, such as but not limited to LEDs, incandescent, and fluorescent light elements. In at least one embodiment, the power beam includes one or more lenses for directing or diffusing light.

The power beams of the present invention can be connected to each other in either an up or down facing orientation and in combinations of up and down facing orientations in order to provide a wide range of configuration layout options as well as functional lighting options and utilities.

The power beam linear lighting system of the invention is comprised of a major beam arrangement, formed as interconnected components, which has multiple linear lighting options and configurations. In addition, the system of the present invention accepts attachable and removable uniquely designed luminaires, track mounted or otherwise attached or incorporated, in either of its two electrical circuits.

In one embodiment, the entire system is comprised of up to four types of component groups which include:

- power beams, typically comprising power rails;
- beam connectors;
- flush bar mounted luminaires for down lighting or up lighting; and
- track mounted luminaires for directional lighting.

Other track lighting and other functional components can be added as well to expand the scope and utility of the system.

One or more of the power beams and connectors are configurable with one or more of the luminaires. Different power beams, different connectors, and different luminaires can be arranged and configured in numerous combinations to create a modular, customizable canopy.

DETAILED DESCRIPTION

Figure 1:
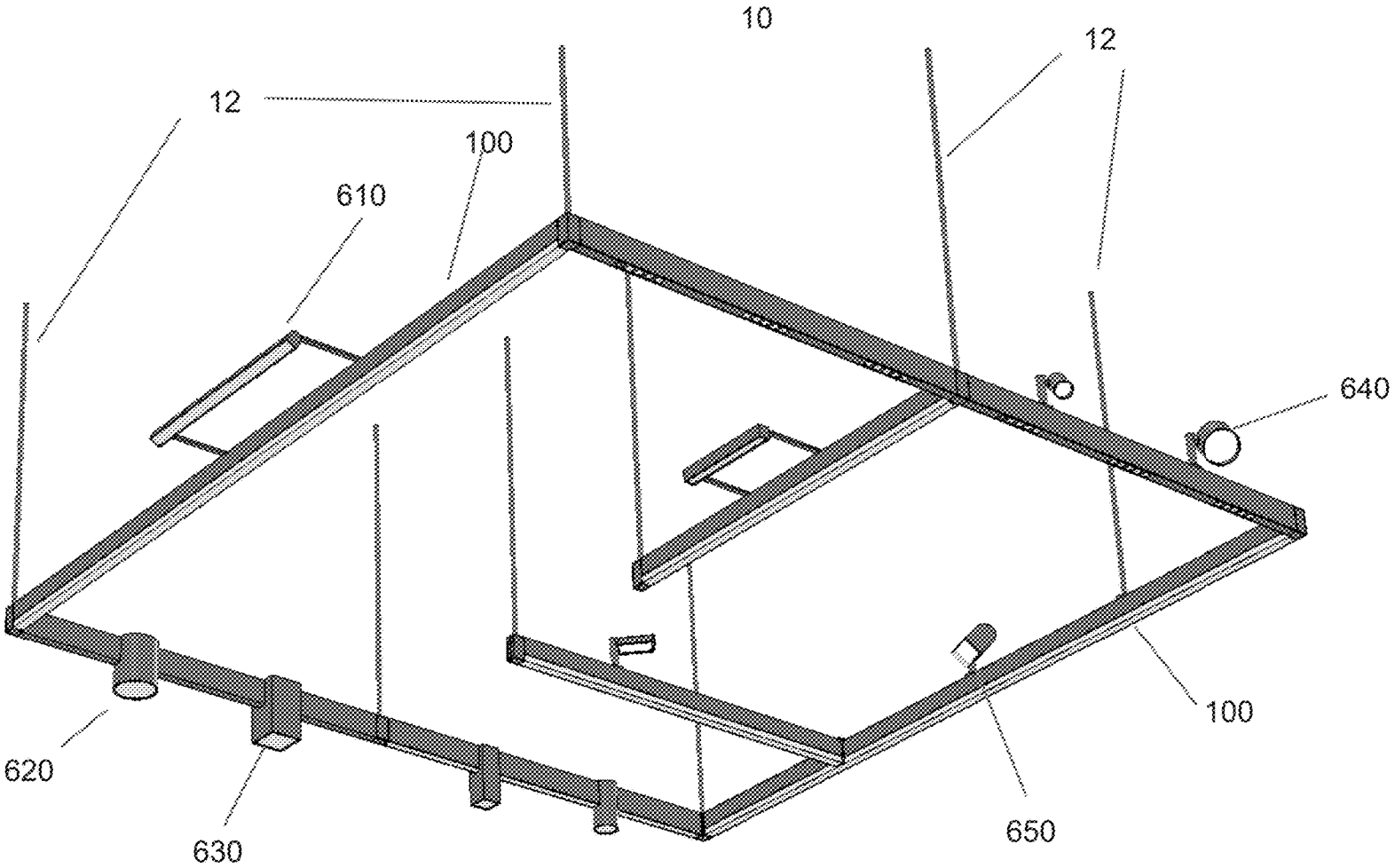
FIG. 1 shows an orthogonal view of a power beam system constructed in accordance with this invention.

As shown in FIG. 1, canopy light system 10 is supportable such as from a ceiling or another architectural member (not shown) by suspenders 12. Some of the suspenders may include several wires to provide power to the canopy system 10, as discussed below, or may be used only for support. That is, the suspenders 12 of the present invention include at least one attachment element for attaching at and/or to the ceiling. One or more power supplies are included in or with the system of the present invention and are housed in or proximal to the ceiling for connecting to wires passing through suspenders 12, or are housed in a ceiling fixture element providing a covering where the suspenders 12 enter the ceiling.

The canopy system 10 of the present invention is flexible in that the size and shape are configurable for a particular situation; however, the configuration is generally planar and thereby rests in a plane, where the plane is typically horizontal. Together, beams and connectors (and lighting elements with illumination sources) form a superstructure canopy. Any number of beams can be attached to form any number of different configurations. Suspenders 12, while ordinarily of the same length for a given system, could have differing lengths such that the system can be hung from, for example, a sloped ceiling yet remain in a horizontal plane. In other embodiments, the arrangement might be planar in a non-horizontal plane.

The canopy system 10 includes several types of beams collectively referred to as beams 100 interconnected by beam connectors. As shown in FIG. 1, in some instances, beams 100 include in-line luminaries or lights, such as circular light 620 or rectangular light 630, while in other instances external lights are hung, such as linear luminaire 610 or single light 650, or otherwise attached to and/or supported by a beam 100, such as spot light 640. Lights may also be embedded, such as embedded light 660 (seen in FIG. 4A), located behind cutout 179. These lighting elements may be LED, incandescent, or fluorescent lighting elements. In at least some situations, the lighting elements are spaced apart in order to allow sufficient heat dissipation. Beams 100 may be interconnected with one another using a variety of connectors, as detailed below.

FIGS. 2A-2C to 6A-6C depict variations in the beams of the present invention. In the present invention, different combinations of these beams are usable to form the structure of a light canopy.

Figure 2A:
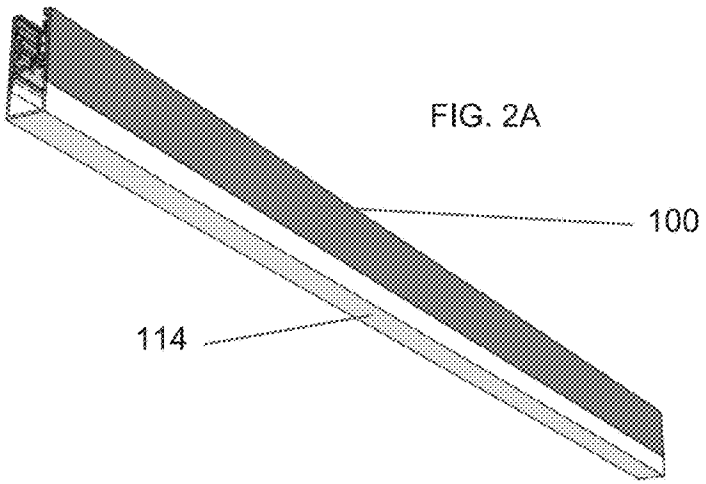
FIGS. 2A, 2B and 2C show views of a powered beam and U-shaped lens that is part of the system of FIG. 1.
Figure 2B:
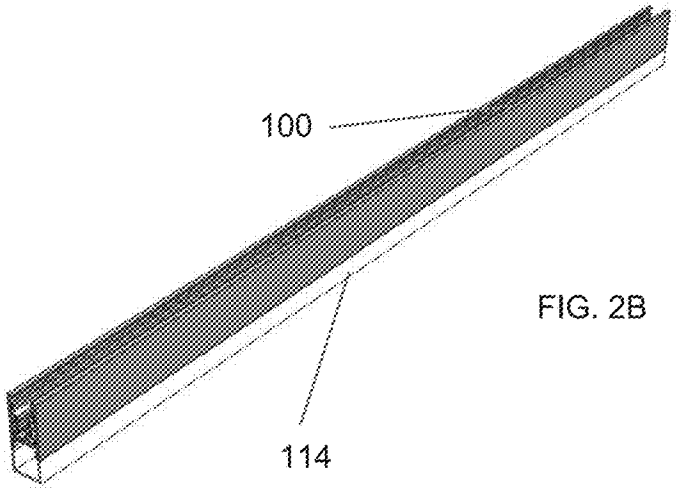
Figure 2C:
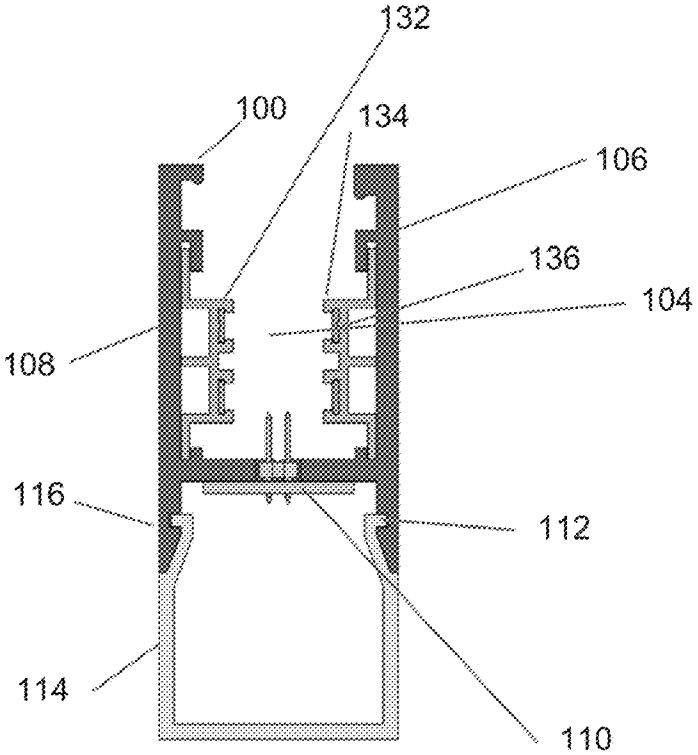

Referring now to FIGS. 2A-2C, which depict different perspectives of beam 100, beam 100 includes a longitudinal channel 104 having generally the shape of a letter H and formed of two opposed parallel vertical wall 106, 108 and a horizontal web 110. The lower portions of the vertical walls have respective facing grooves 112. An optional transparent or translucent 3-sided or U-shaped lens 114 is attached by lip 116 to the grooves 112 to support the lens 114 from the channel 104. That is, the bottom portion of beam 100 functions as a lens for directing or scattering light from one or more embedded light sources. Lens 114 is preferably made of a plastic material or possibly glass or another translucent or transparent material. The sides of channel 104 may be made of a plastic or a metal alloy (such as an aluminum alloy) and can be extruded so that it has the shape as shown.

One or more lights, preferably LED lights (not shown), are attachable to the bottom surface of web 110 and positioned to generate and direct light downward through the lens 114. Lights may be provided along only a single portion, in several portions, or continuously along the whole longitudinal length of the beam 100.

While beam 100 is shown with lens 114 in the downward portion, beam 100 could be mounted so that lens 114 is in the upward portion, reversing beam 100's orientation.

Attached to the inner surfaces of the upper portions of the vertical walls are two bars 132, 134 respectively. Each bar 132, 134 supports up to two power buses 136. The power buses 136 carry power for the light generating components. For example, the system may provide AC or DC power from two different sources. The two power buses 136 may conduct, for example, power from two different circuit breakers, or may have different voltages from one another. In one embodiment, beam 100 may carry only a single set of power buses.

Figure 3A:
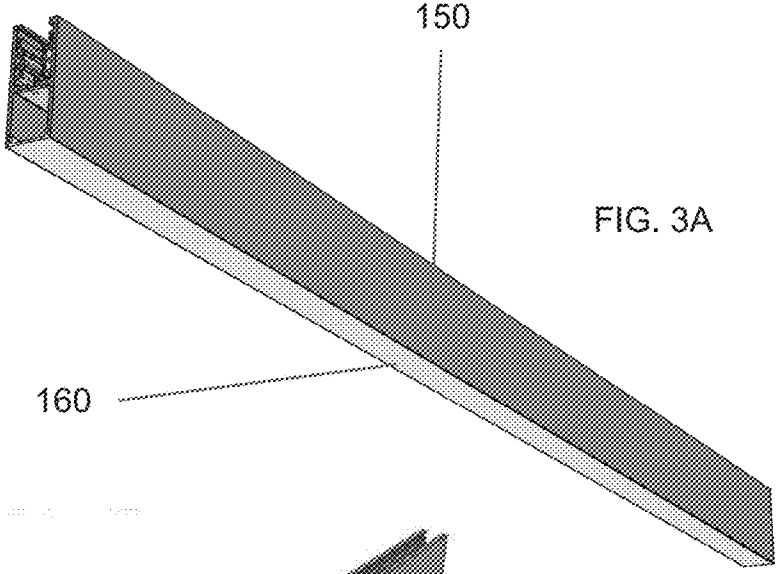
FIGS. 3A, 3B and 3C show views of a powered beam similar to the beam of FIG. 2A-2C with a flat lens.
Figure 3B:
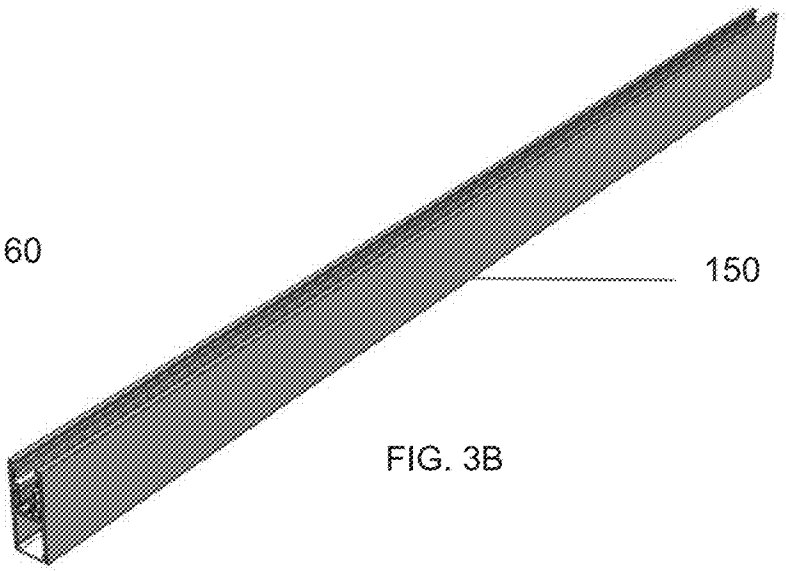
Figure 3C:
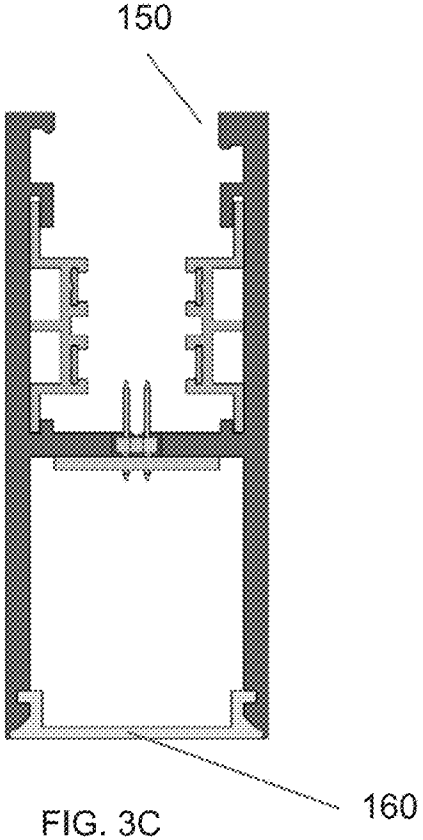

FIGS. 3A-3C show details of an alternate beam 150 made in accordance with the invention. While this configuration and its materials are similar to that described in FIGS. 2A-2C, the primary difference with beam 150 is use of a one-sided lens 160. One-sided lens 160 is a substantially flat shaped lens rather than U-shaped. Lens 160 is mounted similarly to that of lens 114 in FIGS. 2A-2C.

Figure 4A:
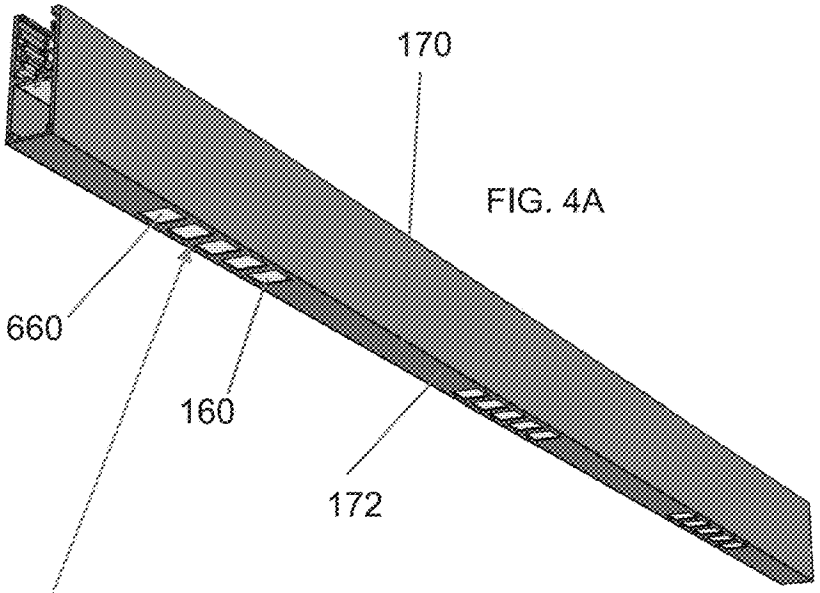
FIGS. 4A, 4B and 4C show views of a powered beam similar to the beam of FIGS. 2A-2C with several individual lights.
Figure 4B:
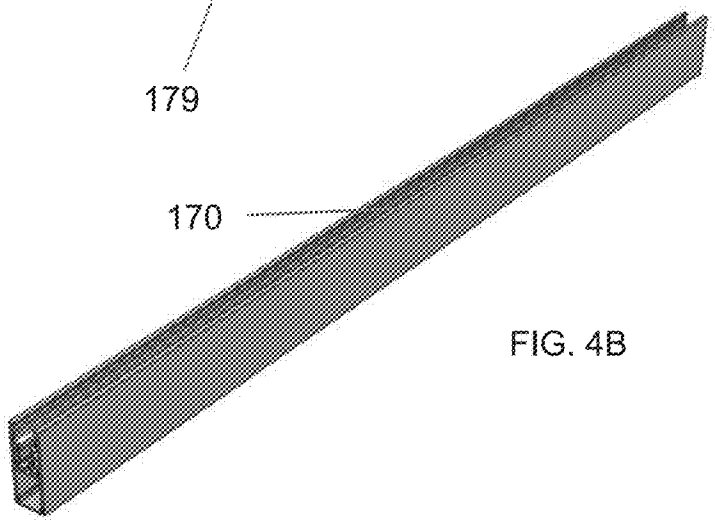
Figure 4C:
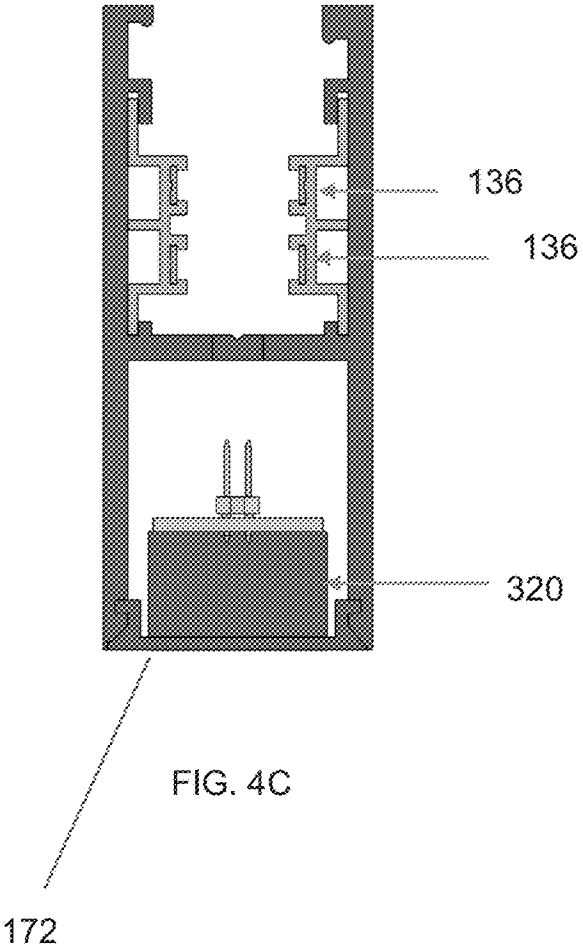

FIGS. 4A-4C show yet another alternate beam 170. While this configuration is similar to that of beam 150, instead of a continuous lens, beam 150 has a generally blank bottom wall 172. A plurality of modular light assemblies 320, such as embedded light 660, are disposed within or along this bottom wall 172 along with a plurality of lenses 160 (see FIG. 4A) positioned in cutouts 179. Each assembly may include LED type lights or other light sources powered from a power bus 136. Each assembly, or some assemblies, may have its own lens, positioned at the bottom, or each lens 160 may be associated with one assembly 320. Light assembly 320 may have a plurality of embedded lights 660. Light from light assemblies 320 are emitted through cutouts 179 in the bottom wall 172. Each of these cutouts can alternatively be an insertable lens 160.

Figure 5A:
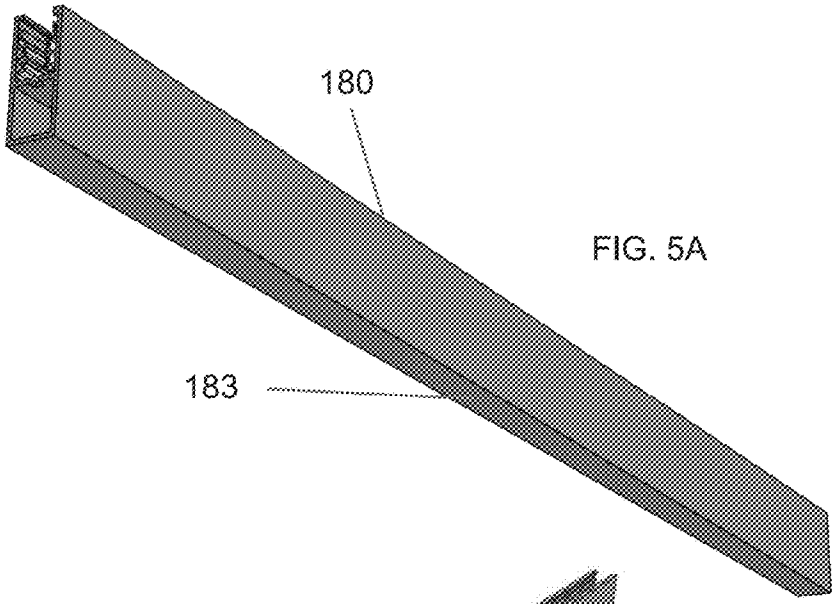
FIGS. 5A, 5B and 5C show views of a powered beam similar to the beam of FIGS. 2A-2C with a closed bottom channel.
Figure 5B:
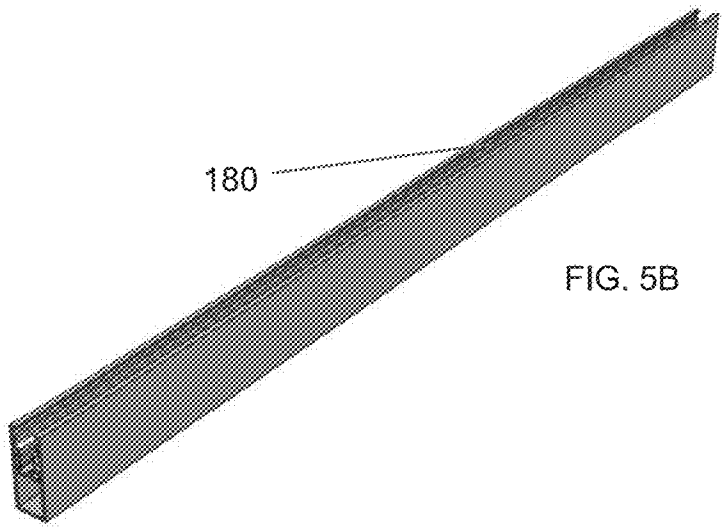
Figure 5C:
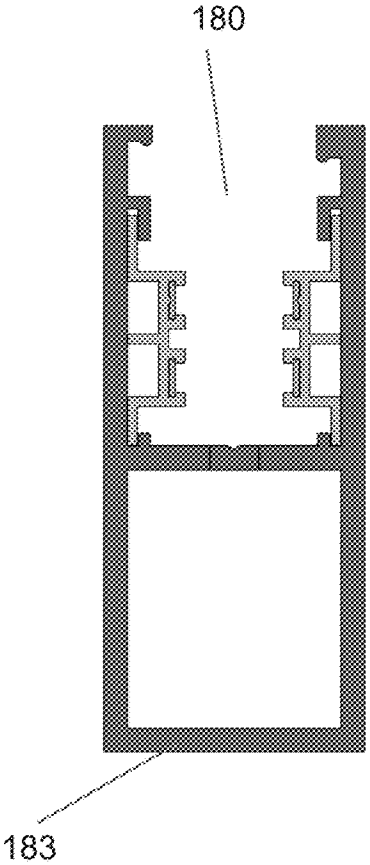

FIGS. 5A-5C show details of an alternate type of beam 180. Beam 180 is similar to beam 170 except that it does not include any internal light generating components, but instead has a blank bottom wall 183.

Figure 6A:
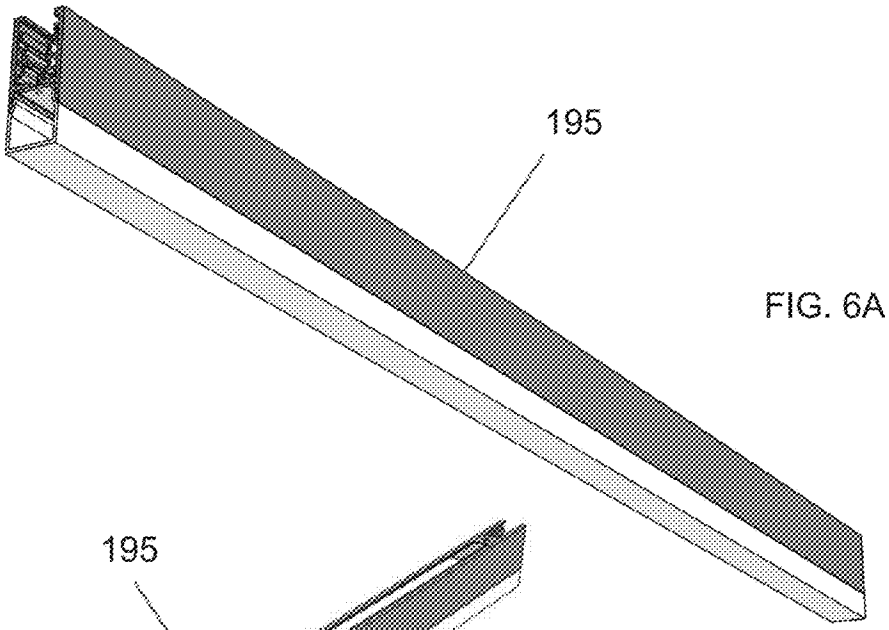
FIGS. 6A, 6B and 6C show views of a powered beam similar to the beam of FIGS. 2A-2C with top modular lights.
Figure 6B:
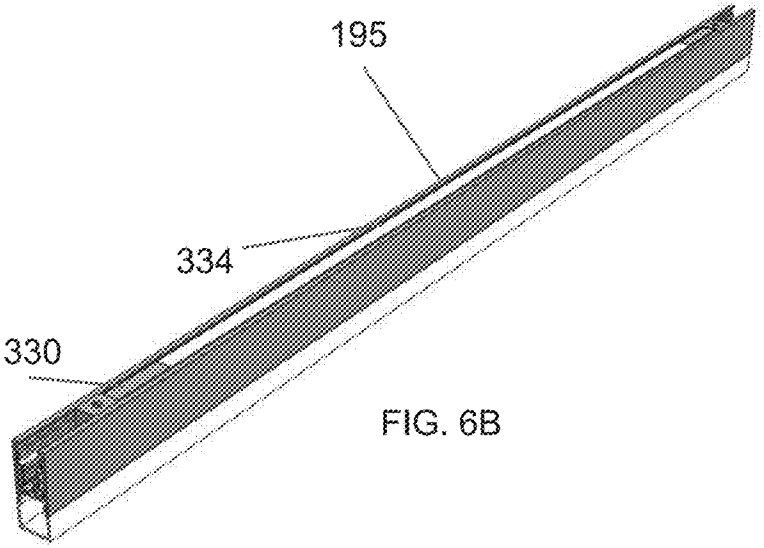
Figure 6C:
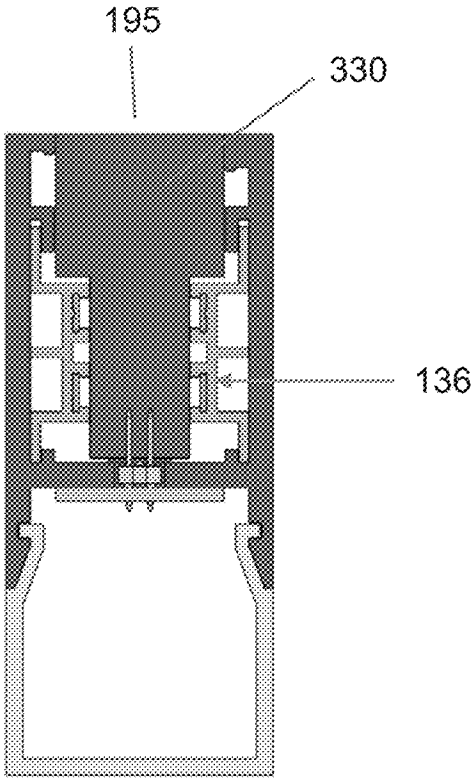

FIGS. 6A-6C show details of another embodiment made in accordance with the invention a beam 195. Beam 195 here includes an insert 330, which is slidably disposed into the upper portion of beam 195. This insert 330 fits between the power buses 136 and is connected to these buses by appropriate clips in order to receive power. One or more light sources may be distributed through the length of the insert 330 and generate light that is directed upwardly through a lens 334 located at the top of beam 195 and, optionally, within insert 330. Moreover, if the beams are inverted, the insert 330 can also be used to direct light downward.

Any of these beams can include single or dual bus rails.

FIGS. 7A-7H through FIGS. 13A-13C depict various types of connectors of the present invention, each of which is usable in forming the canopy system of the present invention. In general, power is delivered to the rails via these connectors and a suspender 12 is attached to a connector. Power originates from a ceiling-based source into at least one suspender 12. Power cables may be embedded within suspender 12 as needed and/or appropriate for distribution through the rails and then to the lighting elements. Once power is in a rail, a second connector may be used to join a second rail in the power distribution path.

Figure 7A:
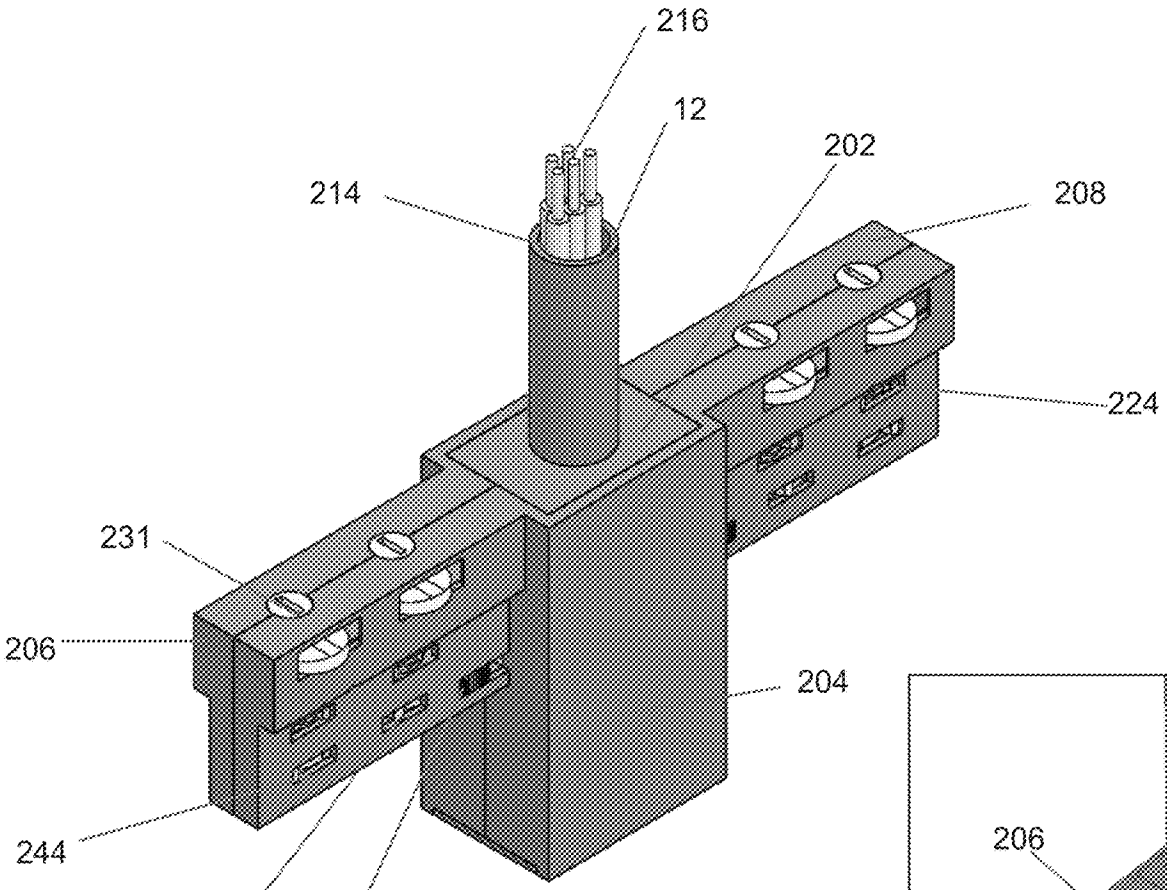
FIGS. 7A-7H show details of an in line two-way connector.
Figure 7B:
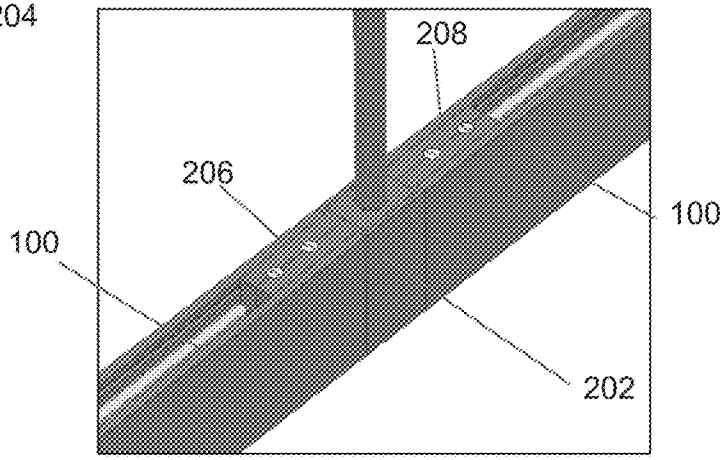
Figure 7D:
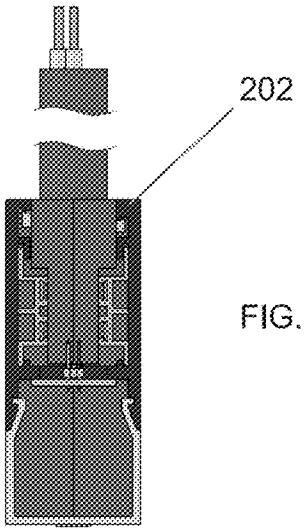
Figure 7F:
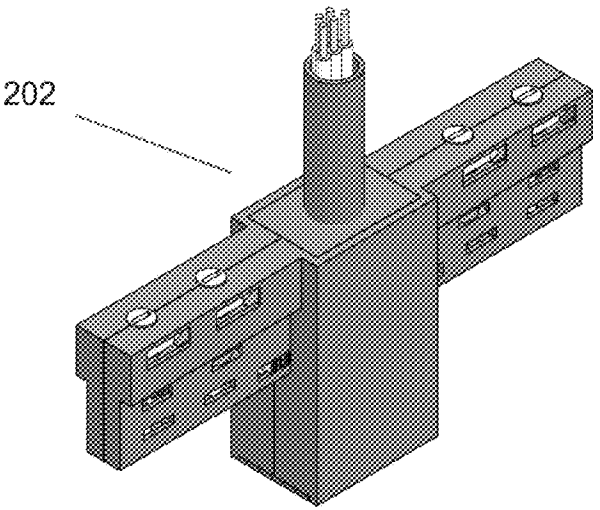
Figure 7C:
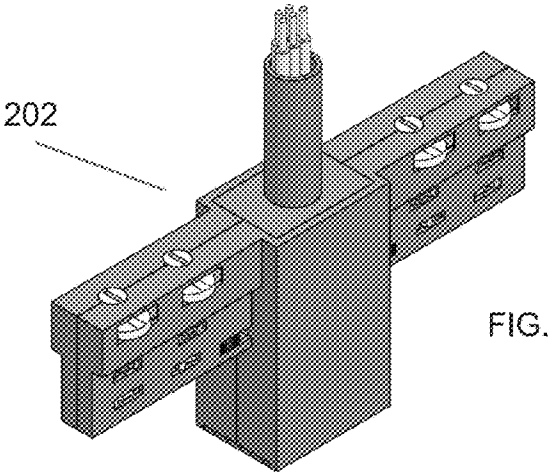
Figure 7E:
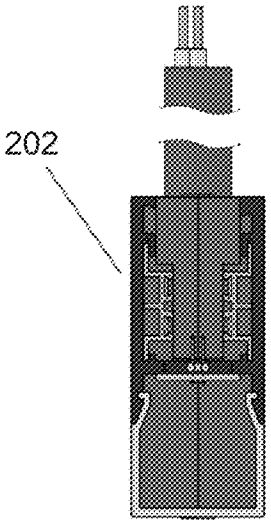
Figure 7G:
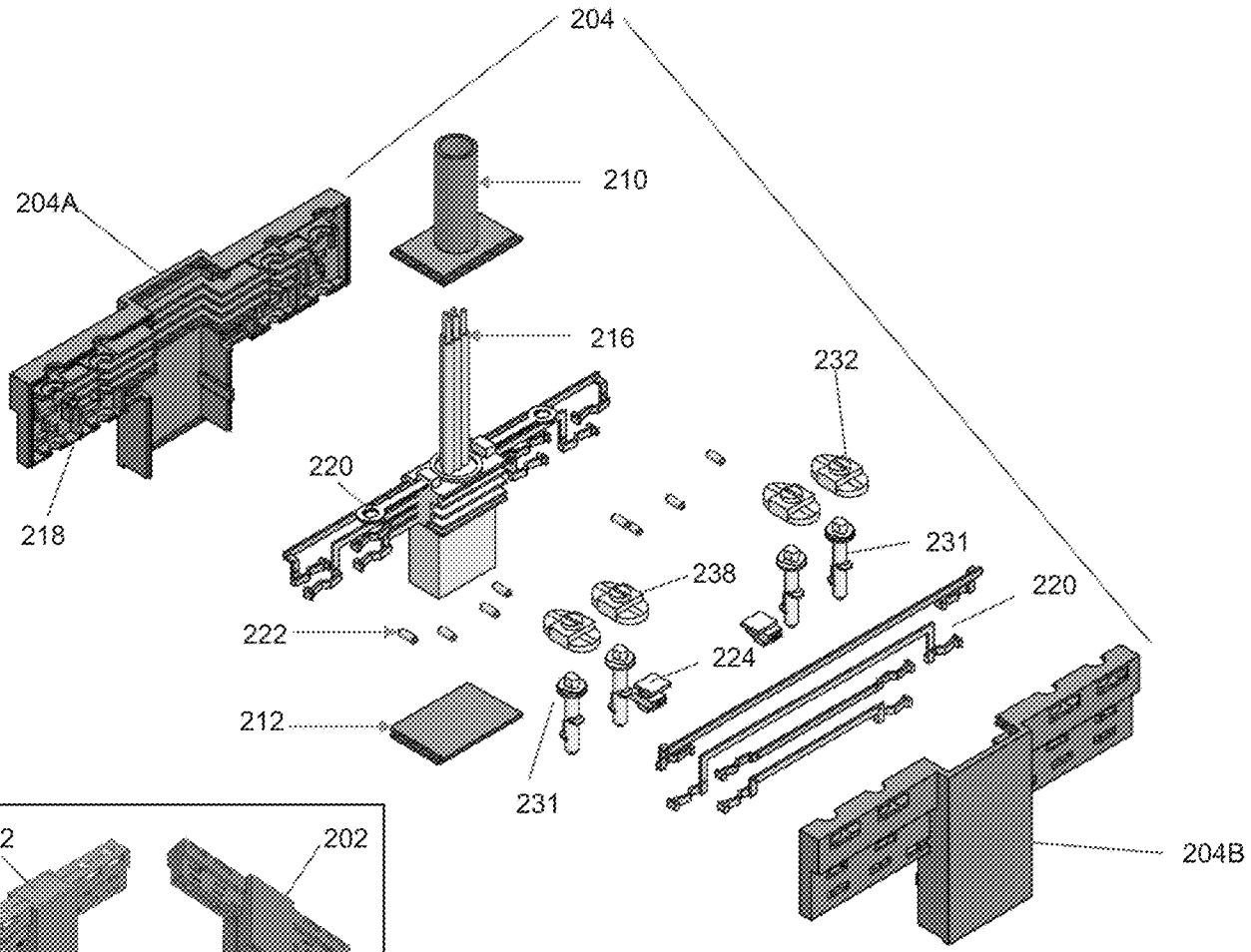

FIGS. 7A-7H show details of a two-way beam connector 202 in a closed position. With reference to FIG. 7B, connector 202 with side wings 206, 208 attaches beams 100. With reference to FIG. 7A, connector 202 includes a T-shaped housing 204 having two side wings 206 and 208. With reference to FIG. 7G, housing 204 can be formed from two segments 204A, 204B that are mated and joined by screws, welding, an adhesive, or other known means. The housing 204 further includes a top cover 210 and a bottom cover 212.

Returning to FIG. 7A, suspender 12 in this case consists of a conduit 214 housing several wires 216. For example, if the connector 202 is used with beam 100 having a single bus, then three wires 216 are provided, including a ground wire. If beam 100 has two buses, then five wires are provided, including a ground wire.

Returning to FIG. 7G, the two segments 204A, 204B are formed with a plurality of shelves or indentations 218 for holding a plurality of flat conducting blades or wires 220. These blades or wires are supported in place by a plurality of posts 222.

Housing 204, including mated segments 204A and 204B and its component parts are shown in FIG. 7G. Housing 204 further includes several electrical switches 224 (see FIG. 7G). Switches 224 are provided on wings 206 and 208. Each of these switches 224 has a respective shaft 231, cap 232, and a slot 238. Wings 206, 208 are visible when the housing segments are closed (see FIG. 7A). The shafts 231 and caps 232 are arranged so that when the housing 204 is assembled, each of the switches 224 can be activated or deactivated by turning the respective shafts 231, such as by slots 238 (for example, using a screw driver blade, not shown). In the off or open position, shafts 231 are positioned so that blades 220 are not connected electrically to any of the wires 216. Turning shaft 231, such as by 90 degrees, causes the shafts to electrically connect each of the blades 220 to one of the wires 216. The position of each switch 224 can be seen from the positions of the wings, as can be seen in FIG. 7A.

Returning to FIG. 7A, housing 204 may further be equipped with slide switches 240. These slide switches 240 are used to activate inserts 330 (if any). See FIGS. 6B-6C.

Each of the housing segments 204A and 204B includes a plurality of openings 244 (see FIG. 7A) and each of the blades 220 potentially terminate in a flexible clip 246 (see FIG. 7A). When the housing 204 is closed, each of the clips 246 protrude through a respective opening 244.

Figure 7H:
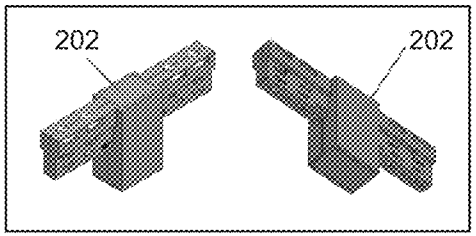

The wings 206, 208 are sized and shaped to fit telescopically through the ends of a respective beam, such as beam 100, 150 etc. (See FIG. 7B). Once the wings are fully inserted into the beams, the beams and the housing form an interference fit which holds these components together. Importantly, clips 246 protruding through openings 244 are arranged so that each makes electric contact with one of the conductors of power bus 136. Thus, connector 202 not only interconnects two beams mechanically, but also potentially provides electrical power to the buses through the switches. In one embodiment, an example of which is shown in FIG. 7H, one or more of connector 202 provides only a mechanical interlock, in which the electrical components discussed above are omitted. FIGS. 7C-7D depict a configuration of the connector with circuit power on. FIGS. 7E-7F depict a configuration of the connector with circuit power off.

From this point going forward, reference to beam 100 is assumed to include reference to all beams described above.

Figure 8B:
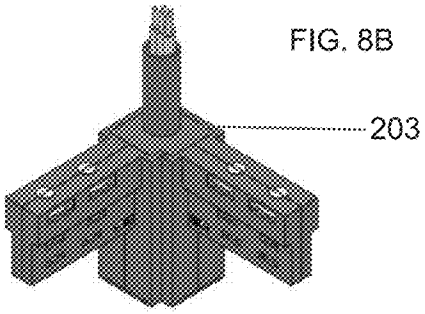
FIGS. 8A-8E show details of a right angle two-way connector.
Figure 8C:
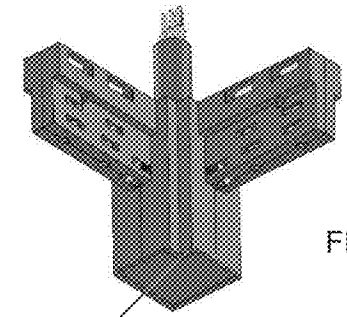
Figure 8A:
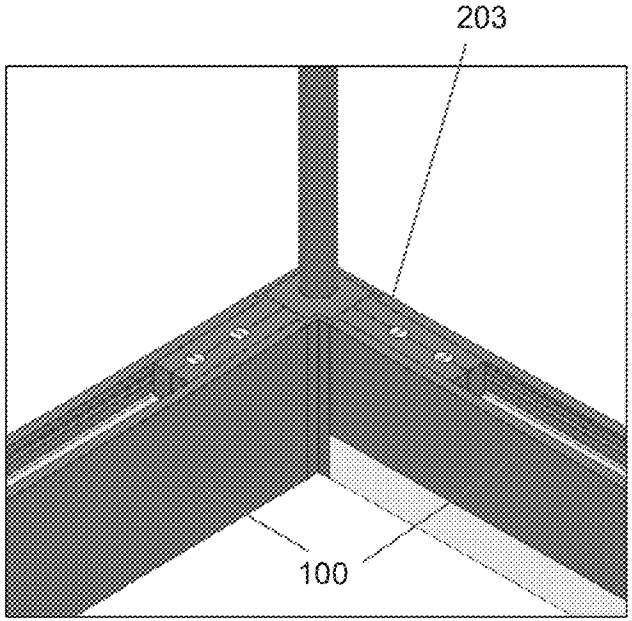
Figure 8D:
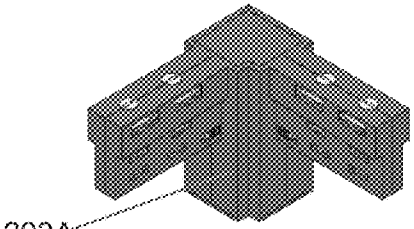
Figure 8E:
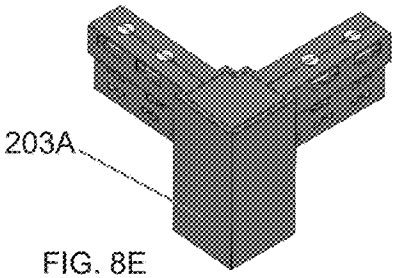

FIGS. 8A-8E show a corner connector 203 that is used to interconnect two beams disposed at right angle to each other. In FIGS. 8A-8C, connector 203 is shown providing power to the beams. In FIGS. 8D and 8E, a connector 203A is shown not providing power to the rails.

Figure 9C:
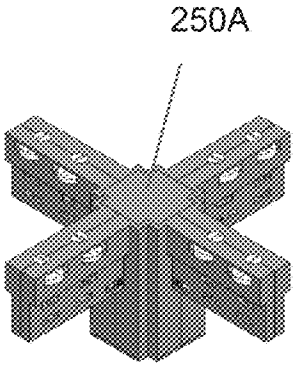
FIGS. 9A-9D show details of a four-way connector.
Figure 9D:
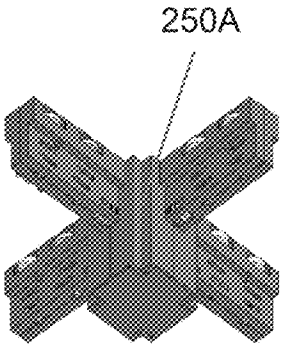
Figure 9A:
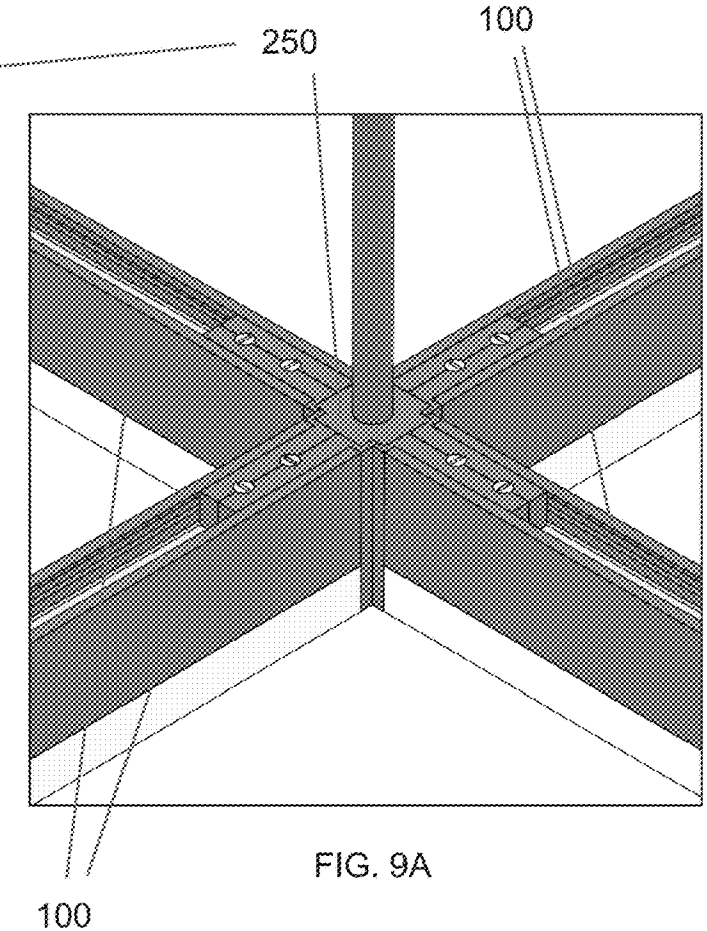
Figure 9B:
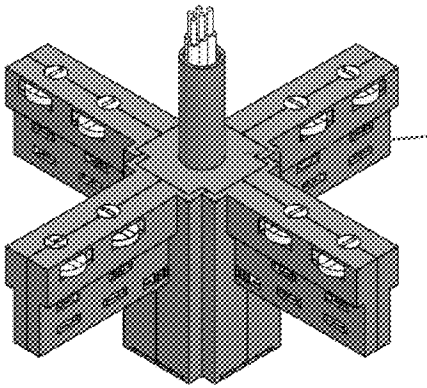

FIGS. 9A-9D show a four-way connector for connecting four beams 100 in cross-configuration. FIGS. 9A-9B each shows a four-way connector 250 that also provides power. FIGS. 9C and 9D show a 4-way connector 250A that does not provide power.

Figure 10C:
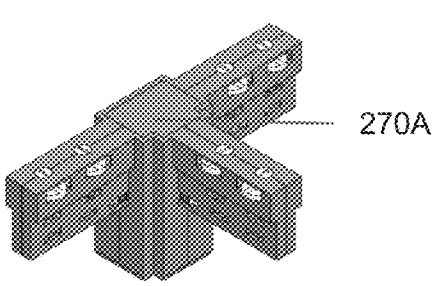
FIGS. 10A-10D show details of a three-way connector.
Figure 10D:
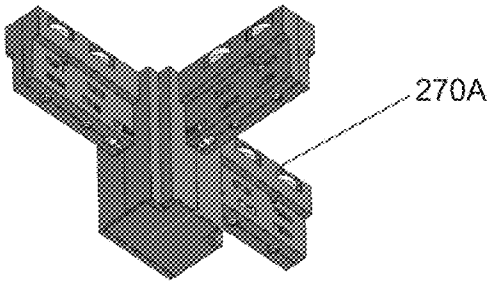
Figure 10A:
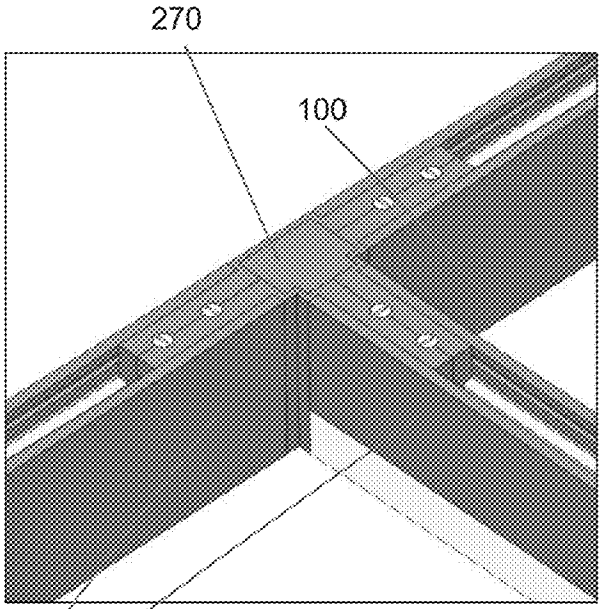
Figure 10B:
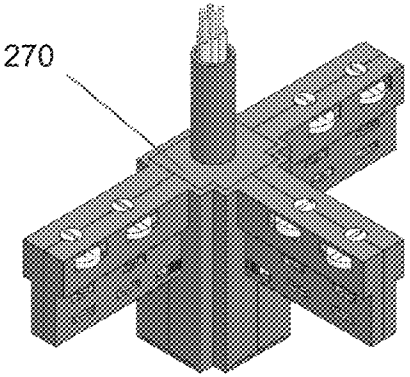

FIGS. 10A-10B show a three-way connector 270 for connecting three beams 100 in a T-shaped configuration in which connector 270 also provides power to the beams. FIGS. 10C-10D show a three-way connector 270A which does not provide power to the beams.

Figure 11A:
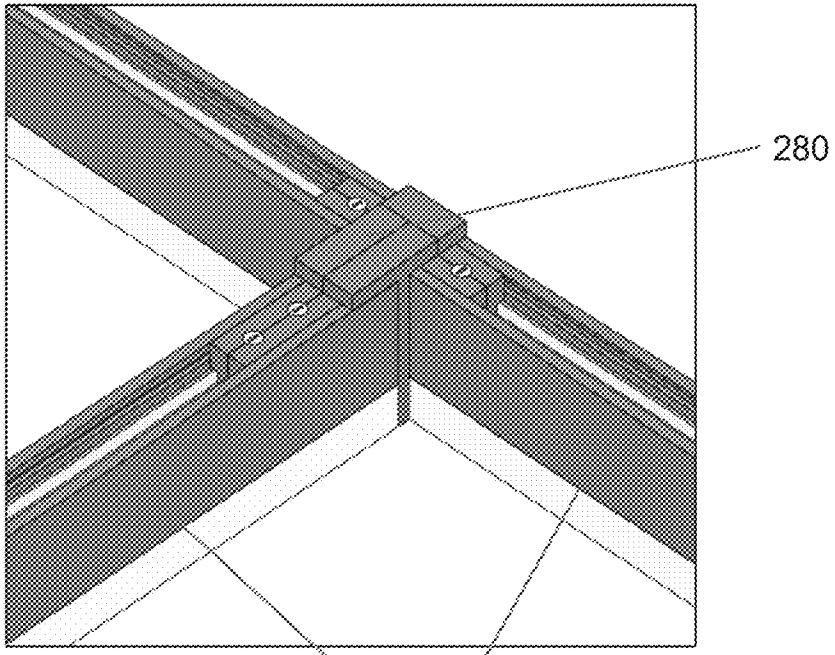
FIGS. 11A-11C show details of a T-shaped connector for connecting midway to a beam.
Figure 11B:
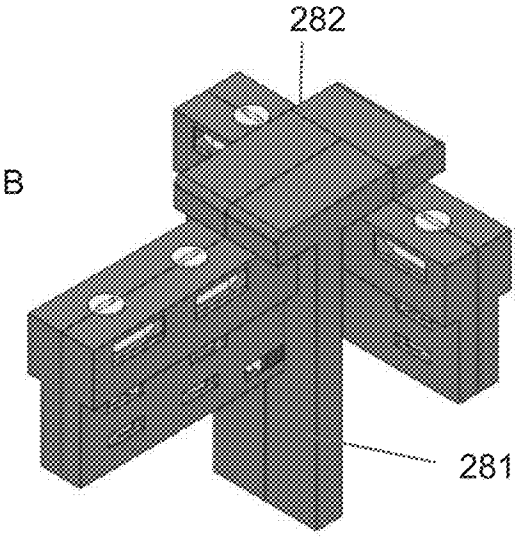
Figure 11C:
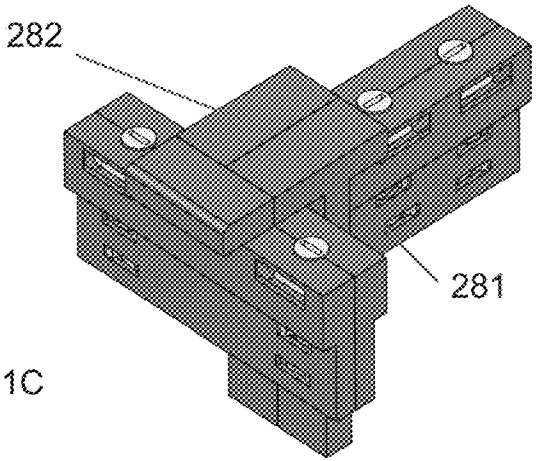

In the embodiments discussed so far, the connectors are inserted into the ends of the respective beams. FIGS. 11A-11C show a connector 280 that can be used to connect the end of one beam 100 to a mid-section of another beam 100. For this purpose, connector 280 has one section 281 sized and shaped to be inserted into the beam 100 and another section 282 that is sized and shaped to be inserted into beam 100 from the top as shown.

Importantly, the beams of the present invention are configurable in a canopy so that any individual beam can be oriented in a first position, as illustrated in FIG. 2A, in which the buses are disposed in the top section of the beams, or in a second position where a beam is turned upside down so that the buses are disposed in the bottom section of the beam.

Figure 12B:
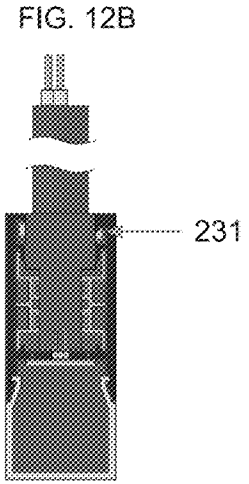
FIGS. 12A-12F show details of a rail inverting connector.
Figure 12A:
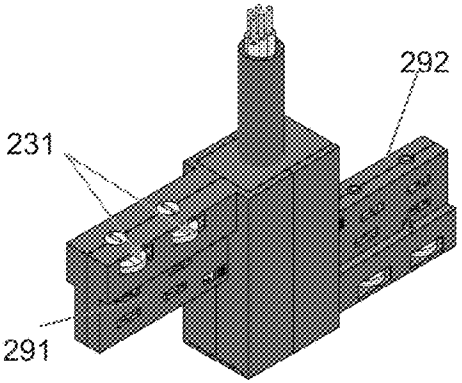
Figure 12F:
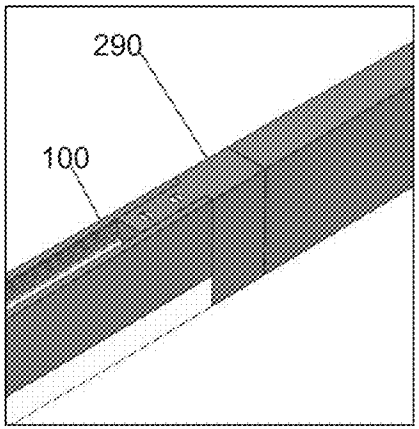
Figure 12C:
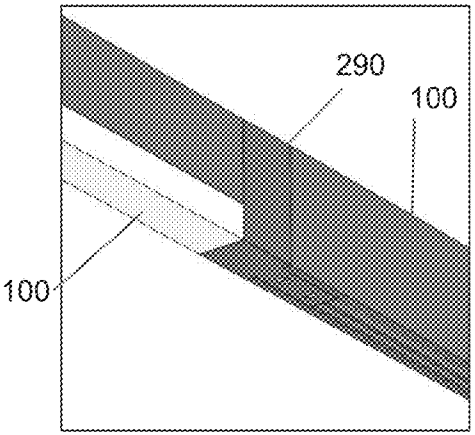
Figure 12D:
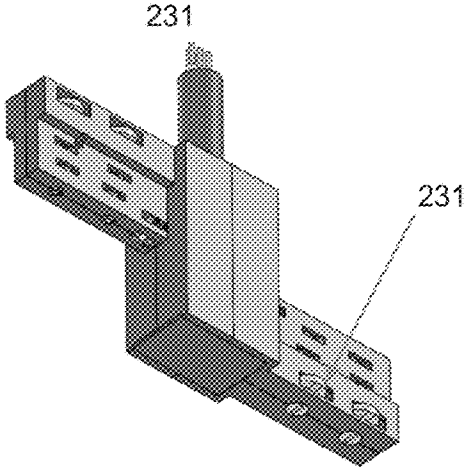
Figure 12E:
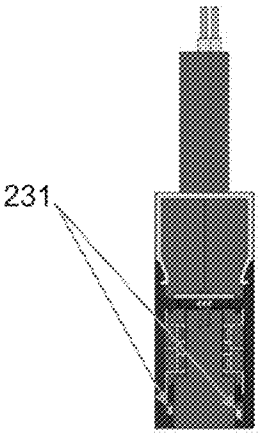

In one version of canopy system 10, all the beams are in the first position or in the second position. However, in some instances, it may be essential to have at least one beam in the first and at least one beam in the second position. For such canopies, a connector 290 is provided, as illustrated in FIGS. 12A-12F. This connector 290 is formed with two segments 291 and 292. Segment 291 is configured to be inserted into a beam in the first position and segment 292 is configured to be inserted into a beam in the second position. In this way, a system can be assembled using the same standard components, but with some beams being in the first position and other beams being in the second position. FIG. 12A depicts connector 290 with segments 291 and 292. FIG. 12B depicts an end view of connector 290 in connection with beams 100. Such a mixed configuration allows for mounting luminaries (and/or directing light) both upward and downward in the same canopy.

Figure 13B:
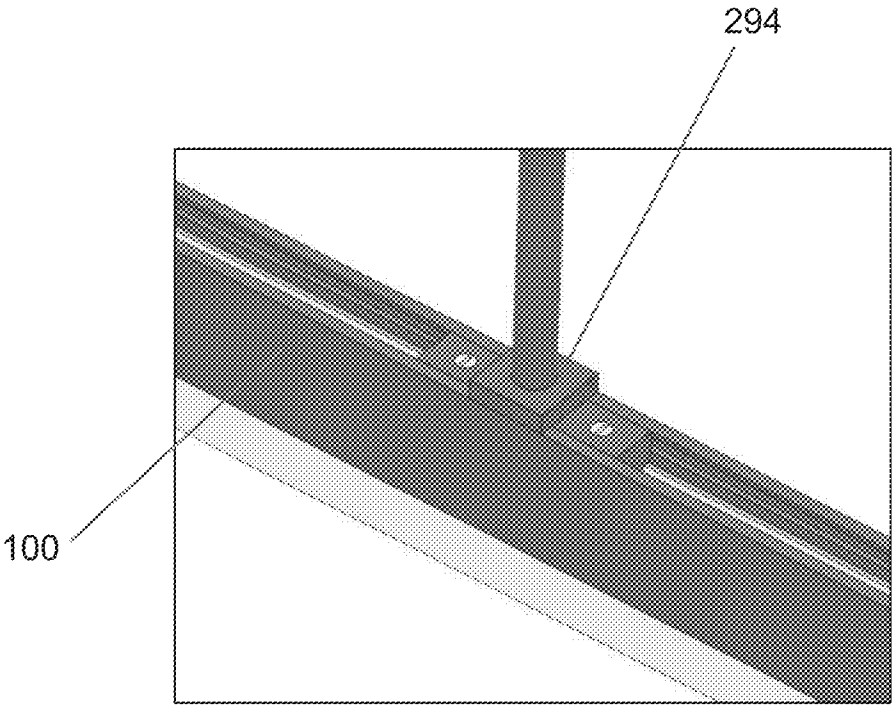
FIGS. 13A-13C show details of a midway beam suspender.
Figure 13A:
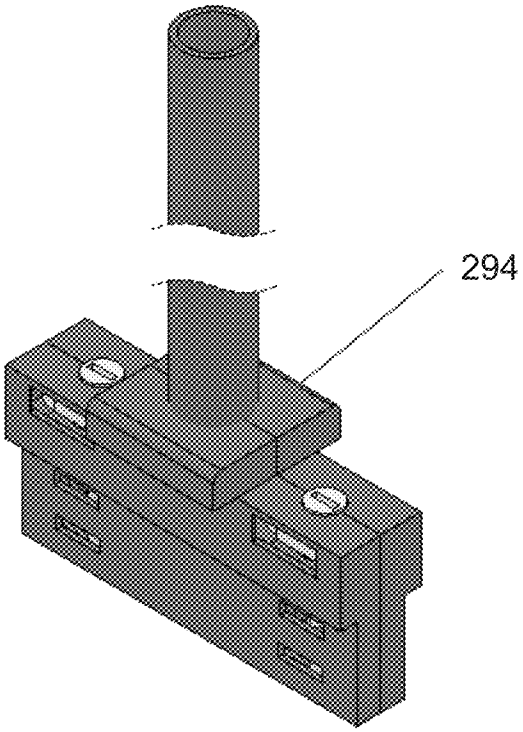
Figure 13C:
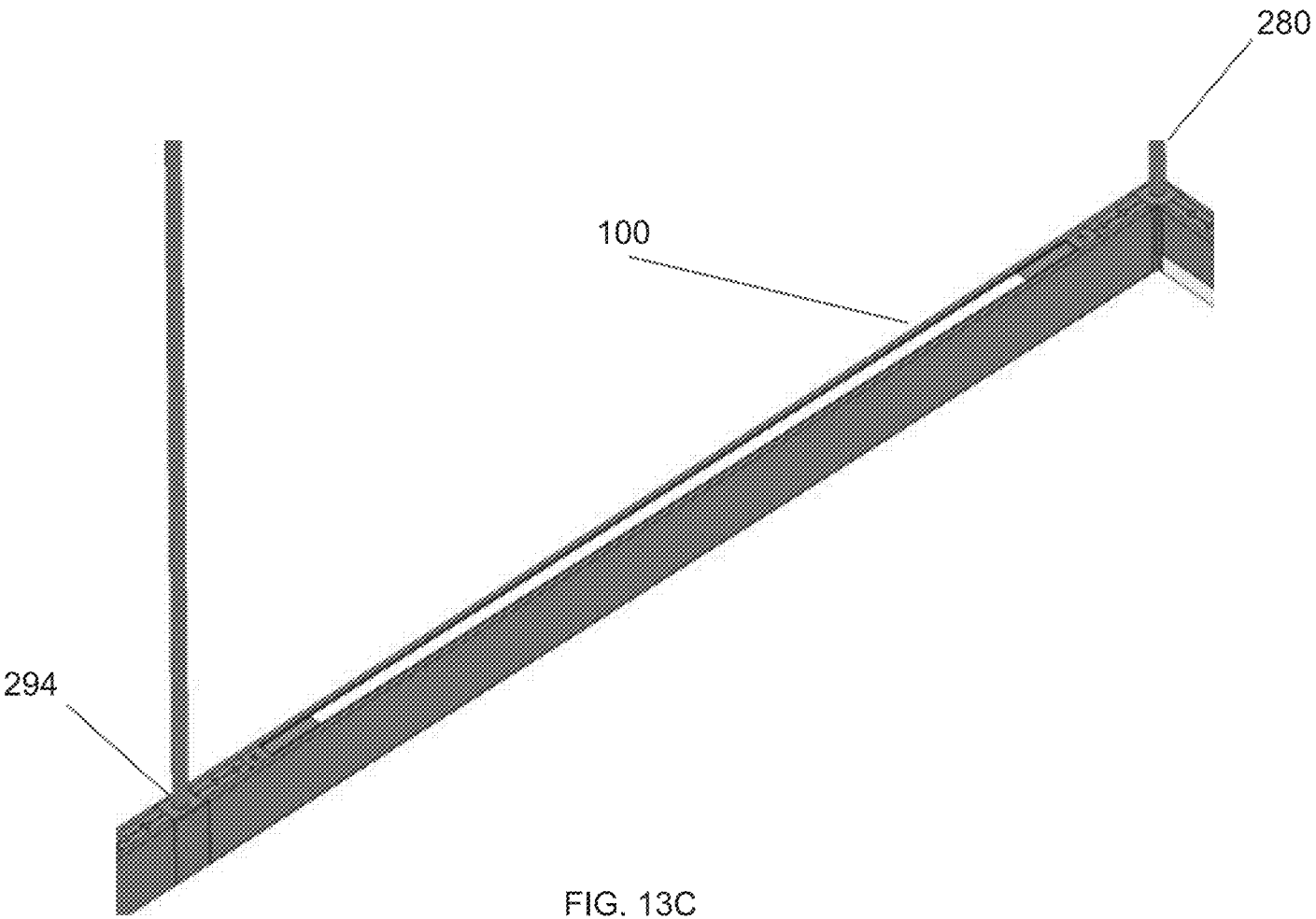

In some embodiments, in may be desirable to provide a connector within a beam 100 somewhere in the beam's midsection rather than at one of its ends. Connector 294, as shown in FIG. 13A, is provided for this purpose. Connector 294 is shown sized so that it can be dropped in from the top. FIG. 13B shows connector 294 in line in a beam 100. FIG. 13C shows an example of connectors 294 and 280 (see also, FIG. 11A) relative to a beam 100.

FIGS. 14A-14B to FIGS. 19A-19C depict various luminaries of the present invention system. In the present invention, guidance may be provided to limit the proximity of one lighting element to another, such as based on the need for heat dissipation.

Figure 14B:
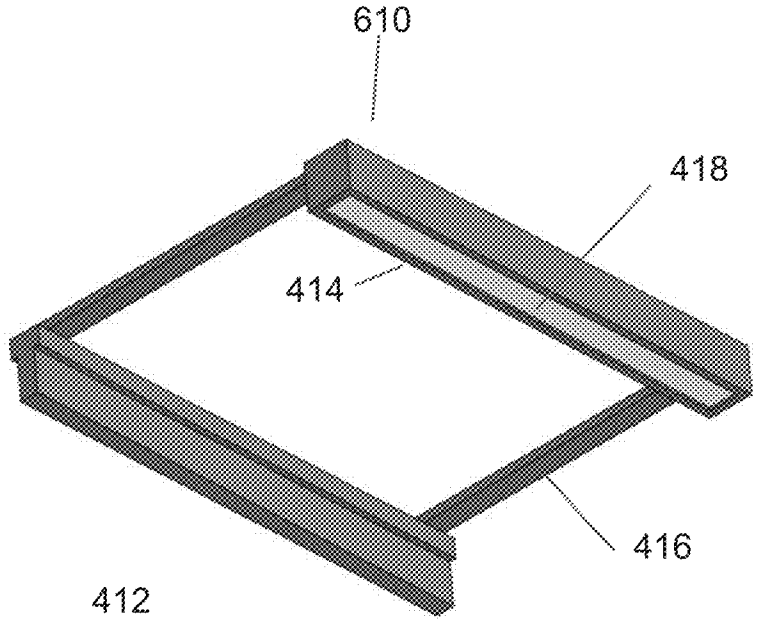
FIGS. 14A-14B show a cantilevered light source for providing personal task lighting.
Figure 14A:
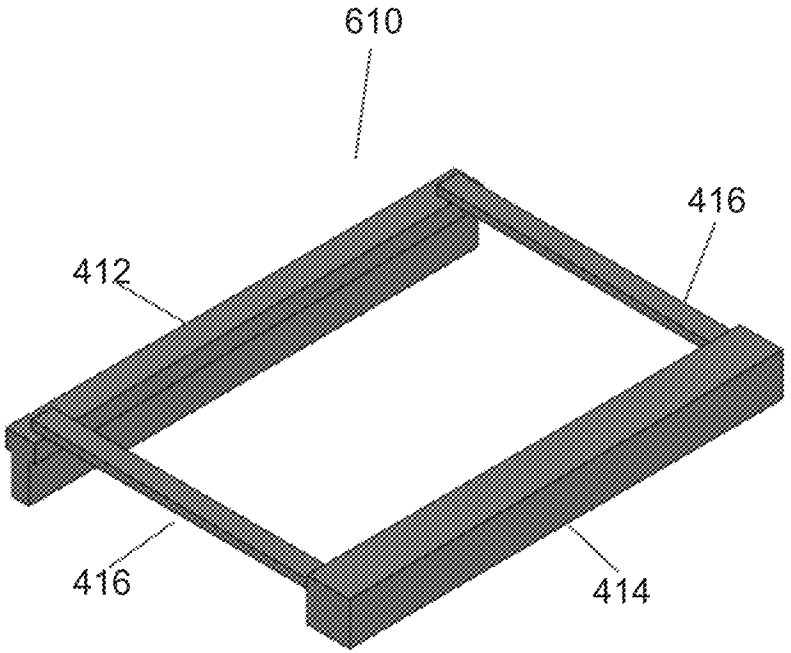

FIG. 14A shows a top down view and FIG. 14B shows a bottom up view of linear luminaire 610. Linear luminaire 610 includes a power section 412 and a lighting section 414. Power section 412 is configured so that it can be dropped into or attached to a beam 100 to support and provide power to linear luminaire 410. In this example, power source 412 is separated from lighting section 414, but this need not be the case. That is, the illuminating portion of linear luminaire 610 is located a distance from beam 100. In different embodiments, the light source in lighting section 414 may be one or more LEDs, incandescent or fluorescent illuminators, or a combination. Lighting section 418 may be equipped with a lens for directing or diffusing light, a cover, or open, there by exposing the lighting source(s). As shown, linear luminaire 610 includes a lens 418. Lens 418 may be 3-sided, 1-sided, or some other lens. Lens 418 may cover one or more lights, such as LEDs (not shown), such as disposed in a row, in one embodiment and may be oriented directly downwardly, for example to provide lighting for a personal work area such as a desk and the like. The two sections 412, 414 may be connected by cross bar 416.

Figure 15B:
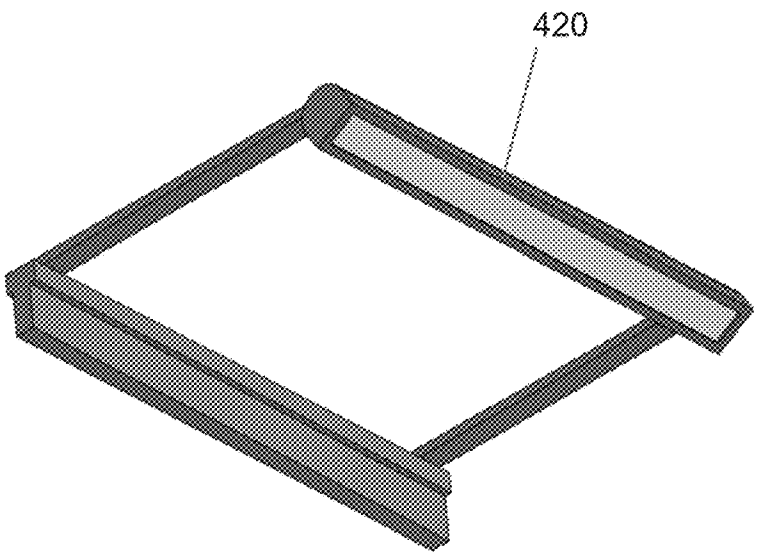
FIGS. 15A-15B show a cantilevered light source for providing lighting for a wall.
Figure 15A:
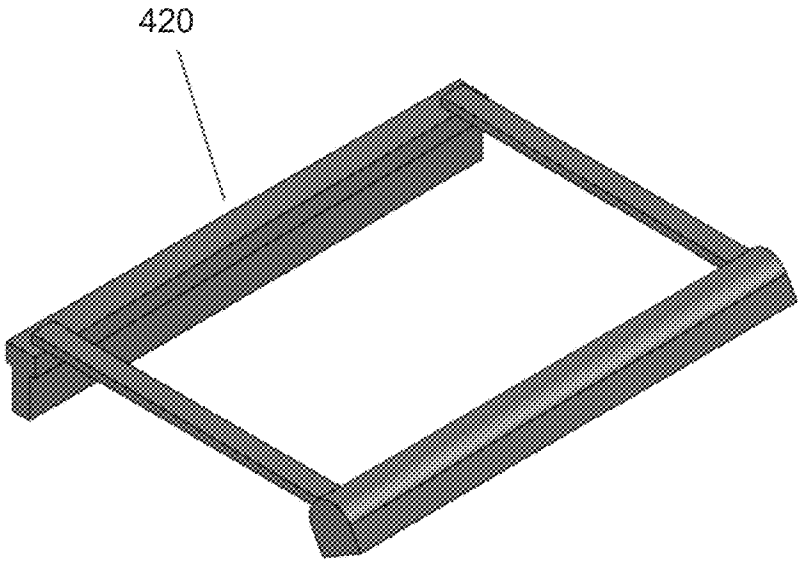

FIG. 15A shows a top down view and FIG. 15B shows a bottom up view of angled linear luminaire 420. Angled linear luminaire 420 is similar to linear luminaire 610 (see FIGS. 5, 14A, and 14B) but is configured to direct light at an angle. This configuration or light source is more suitable for lighting a wall rather than a work space.

Figure 16B:
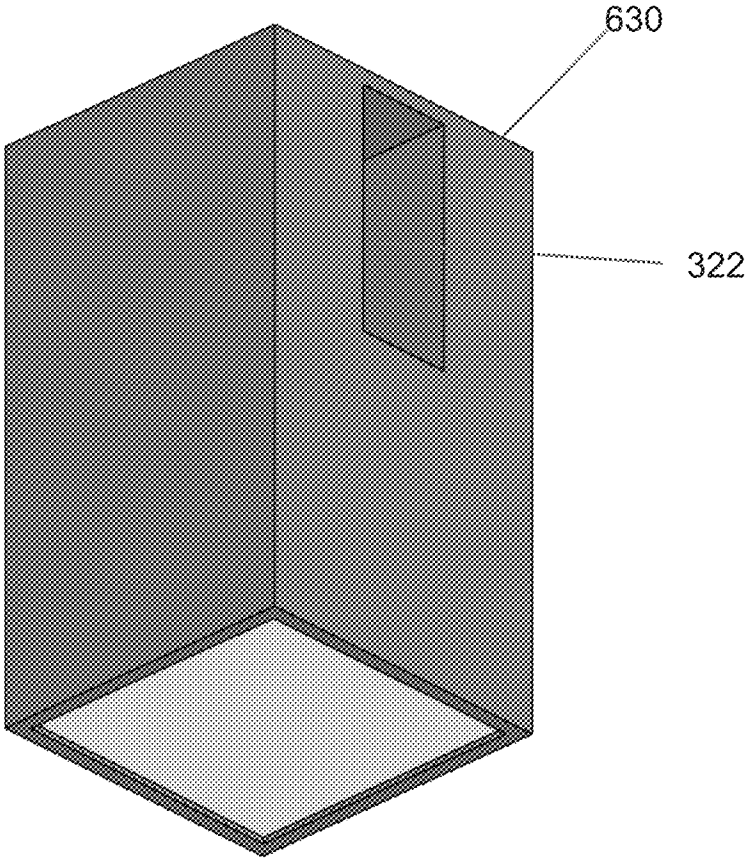
FIGS. 16A-16B show details of rigid light sources having a square cross-section.
Figure 16A:
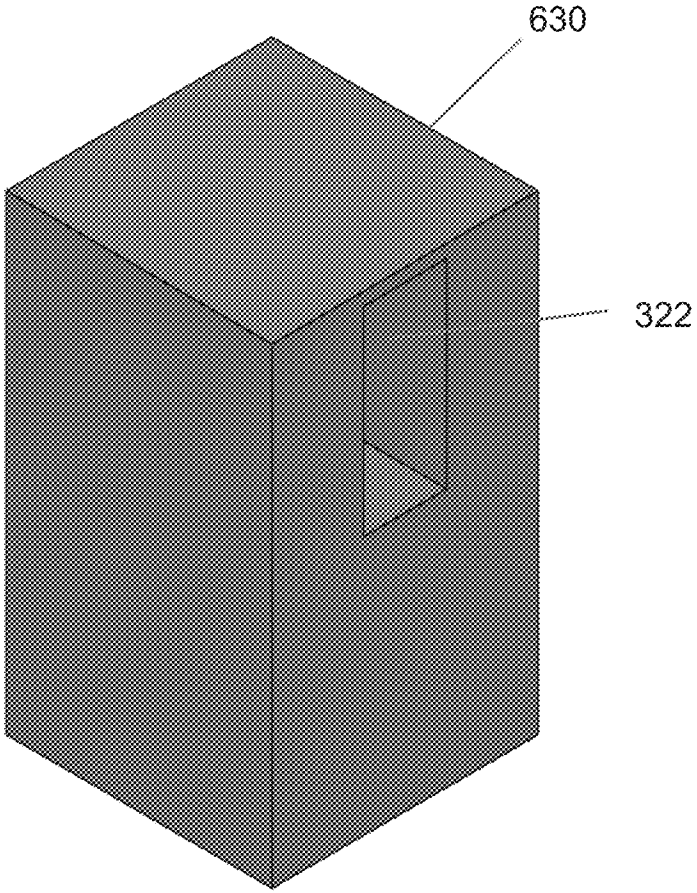

FIG. 16A shows a top down view and FIG. 16B shows a bottom up view of rectangular light 630 with a generally square cross section and with a bottom lens arranged to emit light downwardly. Although shown as generally square in cross section, rectangular light can take the form of another rectangle in cross section. Rectangular light 630 is provided with an opening 322 extending through the light source for mounting on a beam 100. Light 630 may be of varied length and is provided with connecting elements (not shown) disposed in the opening 322 for connecting the light source electrically to the power bus(es) of the respective beam. A lens may be included with rectangular light 630 in order to, for example, direct or diffuse the emitted light.

Figure 17B:
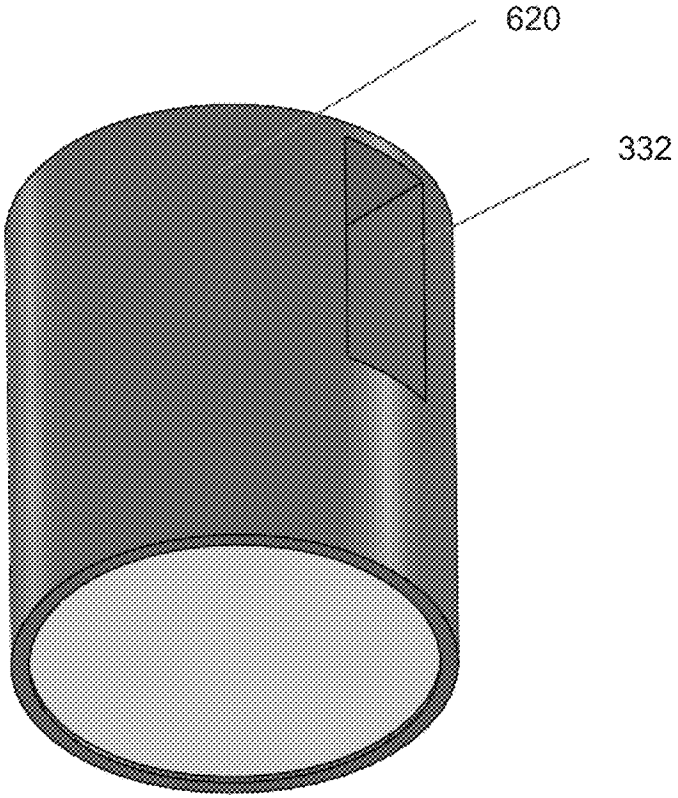
FIGS. 17A-17B show details of rigid light sources having a round cross-section.
Figure 17A:
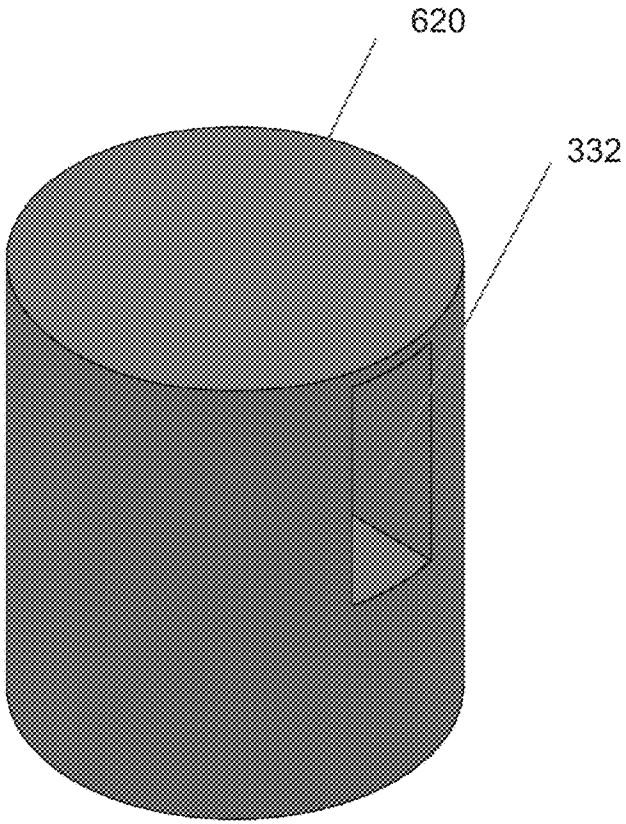

FIG. 17A shows a top down view and FIG. 17B shows a bottom up view of circular light 620 with opening 332 extending through the light source for mounting on a beam 100. Circular light 620 is circular in cross section but may be of varying length. Circular light 620 is provided with connecting elements (not shown) disposed in the opening 332 connecting the light sources electrically to the power buses of the respective beam. Although shown as circular in cross section, it may be oval in cross section or some other roundish or ovalish shape. A lens may be included with circular light source 620 in order to, for example, direct or diffuse the emitted light.

Figure 18B:
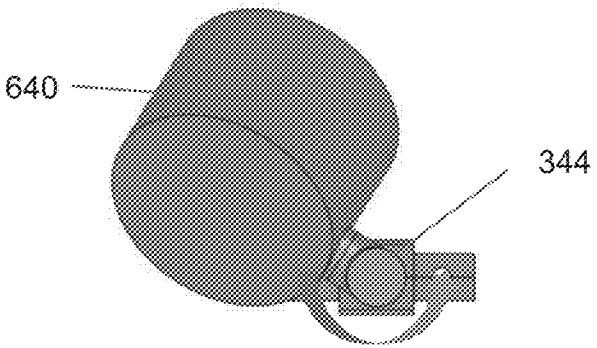
FIGS. 18A-18C show details of pivotable light sources having a round cross-section.
Figure 18C:
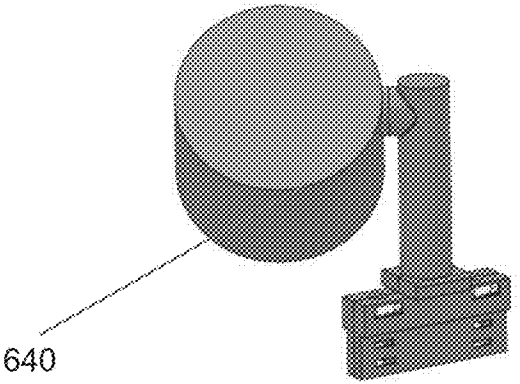
Figure 18A:
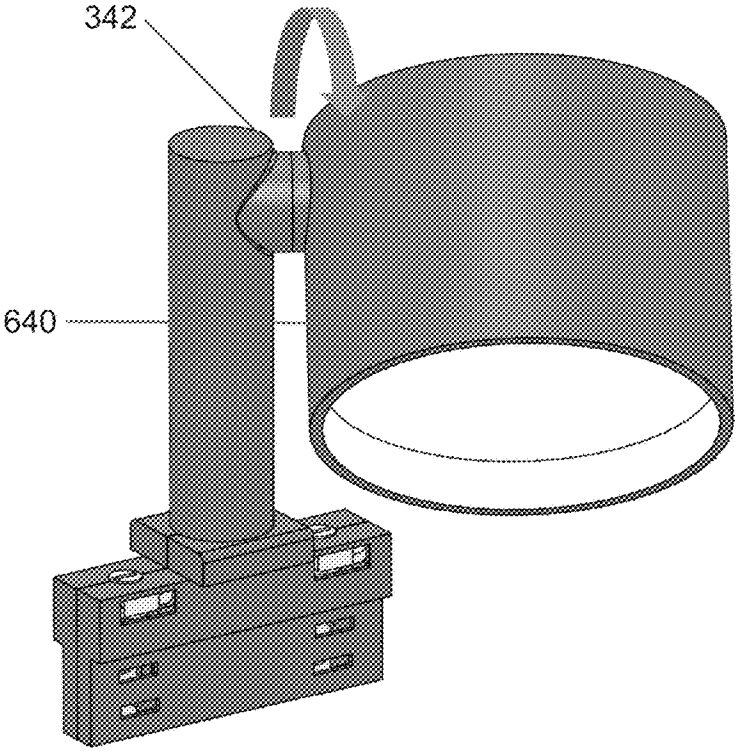

FIGS. 18A-18C show spot light 640 provided with two pivot points 342, 344 to allow spot light 640 to pivot in different directions. Spot light 640 is sizable in different diameters and lengths and may be equipped with a lens in order to, for example, direct or diffuse the emitted light.

Figure 19B:
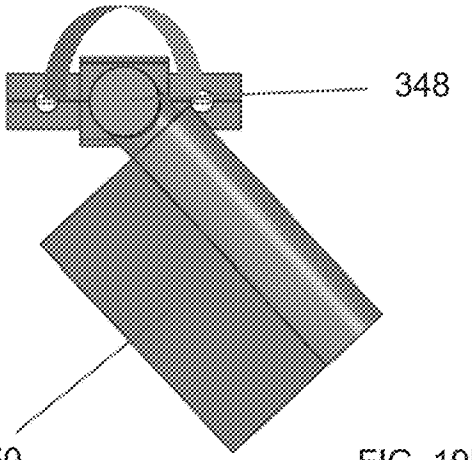
FIGS. 19A-19C show details of pivotable light sources having a rectangular cross-section.
Figure 19C:
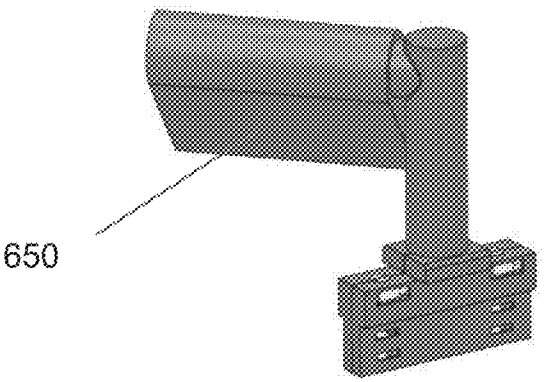
Figure 19A:
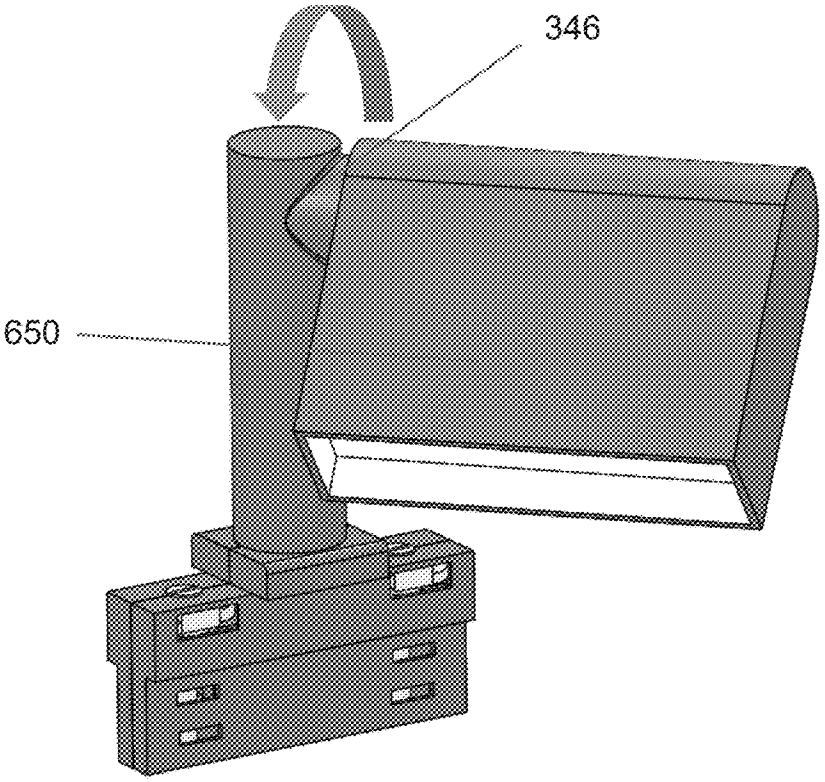

FIGS. 19A-19C show single light 650 provided with two pivot points 346, 348 to allow single light 650 to pivot in different directions. Single light 650 is sizable in different rectangular dimensions and lengths and may be equipped with a lens in order to, for example, direct or diffuse the emitted light.

The invention claimed is:

1. A lighting system, comprising:

a plurality of beams that are arranged in a same plane and that each include at least one electrical power rail housed therein;

at least one connector configured to attach two of said plurality of the beams to each other and including at least one switch housed therein that is adaptable to facilitate and prohibit a transfer of electric power to the two of the plurality of the beams; and at least one lighting element configured to emit light therefrom that is mechanically and electrically connected to at least one of the two of said beams.

2. The lighting system of claim 1, wherein the beams are arranged in a horizontally extending plane.

3. The lighting system of claim 1, wherein the lighting element is housed within at least one of the beams.

4. The lighting system of claim 3, wherein at least one of the plurality of beams includes at least one lens that is aligned with the illumination source to direct light from the illumination source.

5. The lighting system of claim 1, wherein said at least one of the plurality of beams includes a second electrical power rail housed therein and at least one lighting element includes a first lighting element and a second lighting element and the first lighting element is electrically connected to the first electrical power rail and the second lighting element is electrically connected to the second electrical power rail.

6. The lighting system of claim 1, wherein the at least one lighting element is a light-emitting diode.

7. The lighting system of claim 1, wherein the at least one connector includes a housing and at least one wing extending from the housing.

8. The lighting system of claim 7, wherein the at least one wing include a plurality of opening with the switch extendable through one of the openings.

9. The lighting system of claim 1, further comprising one of a plurality of blades and a plurality of wires that are arranged within the at least one connector.

10. The lighting system of claim 1, wherein the switch includes a cap that is connected to the shaft, at least partially arrangable within the at least one connector and rotatable to electrically activate and deactivate the at least one switch.

11. The lighting system of claim 1, wherein the at least one beam includes a first wall, a second wall that is spaced apart from the first wall and a web connecting the first wall and second wall to each other.

12. The lighting system of claim 11, wherein the at least one connector includes a wing configured to be inserted into an end of the at least one beam, the wing configured to be disposed between the first wall and the second wall when inserted into the end of the at least one beam to electrically and mechanically connect the at least one beam to the at least one connector.

13. The lighting system of claim 12, wherein the wing includes at least one opening and one of a conducting wire and a blade arranged within the wing, protruding from the opening of the wing and configured to contact the at least one electrical power rail to electrically connect the at least one beam to a power source.

14. A lighting system, comprising:

a plurality of supports configured to suspend the lighting system from a surface;

a plurality of power beams that each include at least one power rail and are configured to be electrically attached to a lighting source;

a plurality of connectors configured to attach two of the plurality of power beams both mechanically and electrically to each other and each including a housing, at least one of the supports extending from the housing and at least two switches that are arranged within the housing being adaptable to facilitate and prohibit a transfer of electric power to at least one of the plurality of beams; and at least one lighting element configured to emit light therefrom that is attached to the at least one of the plurality of beams.

15. The lighting system of claim 14, wherein said at least one power rail is a dual track power rail that includes a first power rail and a second power rail that is spaced from the first power rail and the at least one lighting element includes at least a first lighting element that is attached to the first power track and a second lighting element that is attached to the second power track.

16. The lighting system of claim 14, wherein at least one connector includes a housing, a first wing extending from the housing, a second wing extending form the housing and a third wing extending from the housing, the first wing, the second wing and the third wing attaching at least three beams to each other.

* * * * *